US012564217B2

(12) United States Patent
Jung et al.

(10) Patent No.: US 12,564,217 B2
(45) Date of Patent: Mar. 3, 2026

(54) NICOTINE INHALER

(71) Applicant: KT&G CORPORATION, Daejeon (KR)

(72) Inventors: Yong Mi Jung, Daejeon (KR); Mi Jeong Lee, Daejeon (KR); Jun Won Shin, Daejeon (KR); Eun Mi Jeoung, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 481 days.

(21) Appl. No.: 17/927,242

(22) PCT Filed: Jun. 23, 2022

(86) PCT No.: PCT/KR2022/008952
§ 371 (c)(1),
(2) Date: Nov. 22, 2022

(87) PCT Pub. No.: WO2023/022353
PCT Pub. Date: Feb. 23, 2023

(65) Prior Publication Data

US 2025/0072492 A1 Mar. 6, 2025

(30) Foreign Application Priority Data

Aug. 18, 2021 (KR) ..... 10-2021-0108543

(51) Int. Cl.
*A24F 40/10* (2020.01)
*A24B 15/24* (2006.01)

(52) U.S. Cl.
CPC ..... *A24F 40/10* (2020.01); *A24B 15/243* (2013.01)

(58) Field of Classification Search
None
See application file for complete search history.

(56) References Cited

U.S. PATENT DOCUMENTS 10,456,539 B2 10/2019 Hearn et al.
2017/0086502 A1 3/2017 Hearn et al.
(Continued)

FOREIGN PATENT DOCUMENTS

CN 106455706 A 2/2017
CN 207076343 U 3/2018
(Continued)

OTHER PUBLICATIONS

International Search Report for PCT/KR2022/008952 dated Nov. 18, 2022.
(Continued)

*Primary Examiner* — Dionne W. Mayes
(74) *Attorney, Agent, or Firm* — Sughrue Mion, PLLC

(57) ABSTRACT

The present invention provides a nicotine inhaler including: a body including a housing and a venturi tube disposed in the housing; a liquid nicotine storage; and a liquid supplying tube that supplies the liquid nicotine into the venturi tube, wherein the venturi tube includes an inlet pipe section communicating with an air intake port at one end of the housing, a central pipe section having a liquid injection hole on a wall thereof, and an outlet pipe section communicating with an inhalation port at the other end of the housing, and the liquid supplying tube is disposed to communicate with the liquid nicotine storage and the liquid injection hole of the central pipe section.

9 Claims, 8 Drawing Sheets

(56) References Cited

U.S. PATENT DOCUMENTS

| | | | |
|---|---|---|---|
| 2017/0360093 | A1 | 12/2017 | Fernando |
| 2018/0014574 | A1 | 1/2018 | Rogan |
| 2018/0235280 | A1 | 8/2018 | Biel et al. |
| 2019/0313699 | A1 | 10/2019 | Rogan |
| 2019/0343169 | A1 | 11/2019 | Muhammed et al. |
| 2020/0359694 | A1 | 11/2020 | Kane et al. |
| 2021/0138052 | A1 | 5/2021 | Song et al. |
| 2022/0023556 | A1 | 1/2022 | Bowen et al. |

FOREIGN PATENT DOCUMENTS

| | | | |
|---|---|---|---|
| CN | 212414723 | U | 1/2021 |
| EP | 3 733 002 | A1 | 11/2020 |
| EP | 3 795 005 | A1 | 3/2021 |
| JP | 2013-500809 | A | 1/2013 |
| KR | 10-1734932 | B1 | 5/2017 |
| KR | 10-2018-0028493 | A | 3/2018 |
| RU | 2 701 846 | C2 | 10/2019 |
| RU | 2 707 079 | C2 | 11/2019 |
| WO | 2020/115147 | A1 | 6/2020 |
| WO | 2020/115155 | A1 | 6/2020 |

OTHER PUBLICATIONS

Communication dated Sep. 17, 2024, issued in Russian Application No. 2022129980/03.

Communication issued Jul. 29, 2025 in Japanese Application No. 2022-568580.

Japanese Office Action dated Mar. 4, 2025 in Application No. 2022-568580.

【Figure 1】
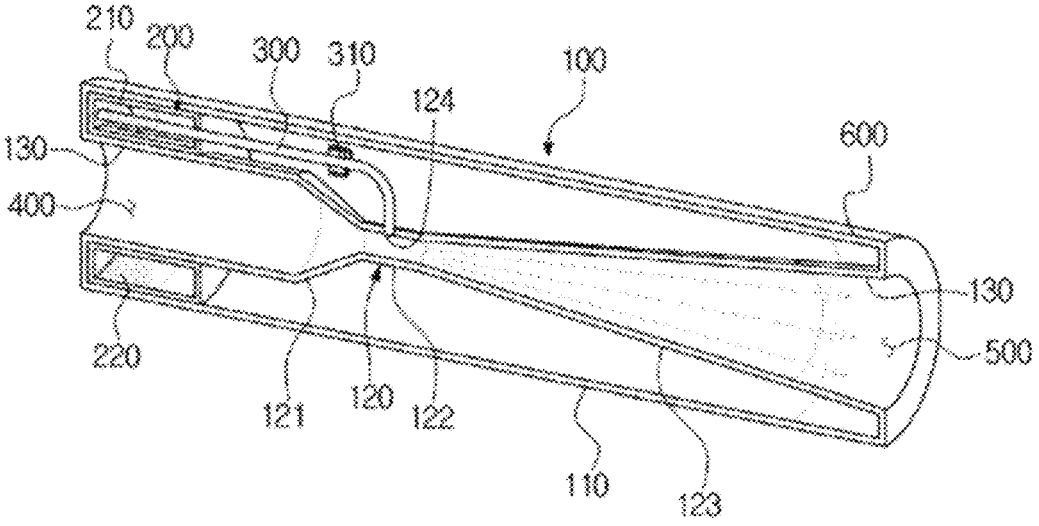
【Figure 2】
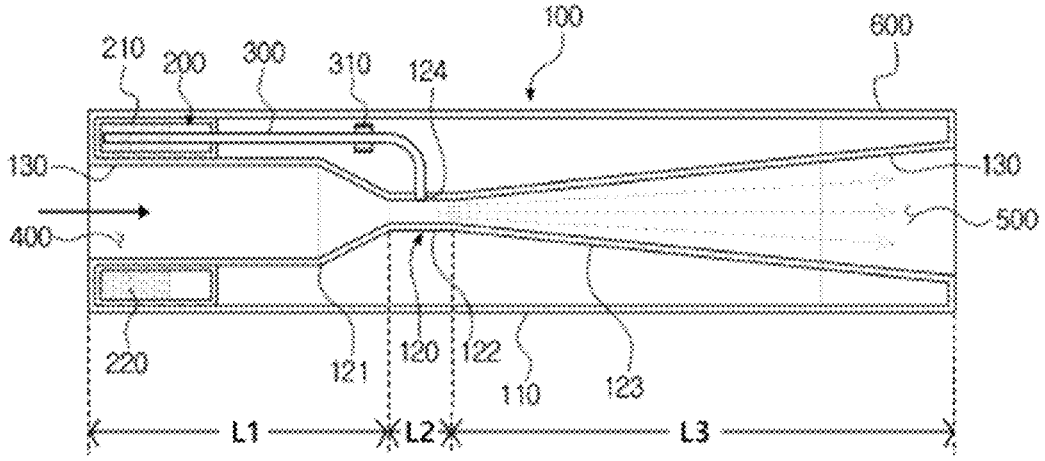

【Figure 3】
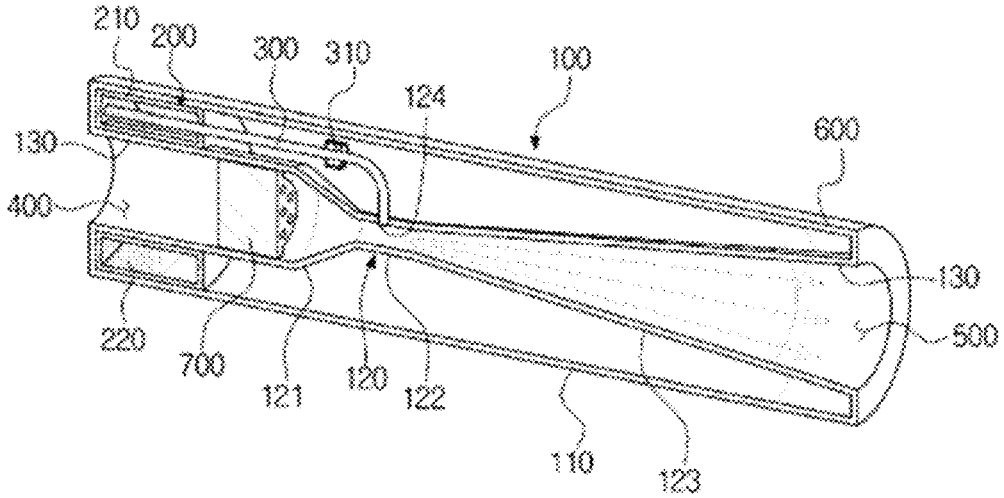
【Figure 4】
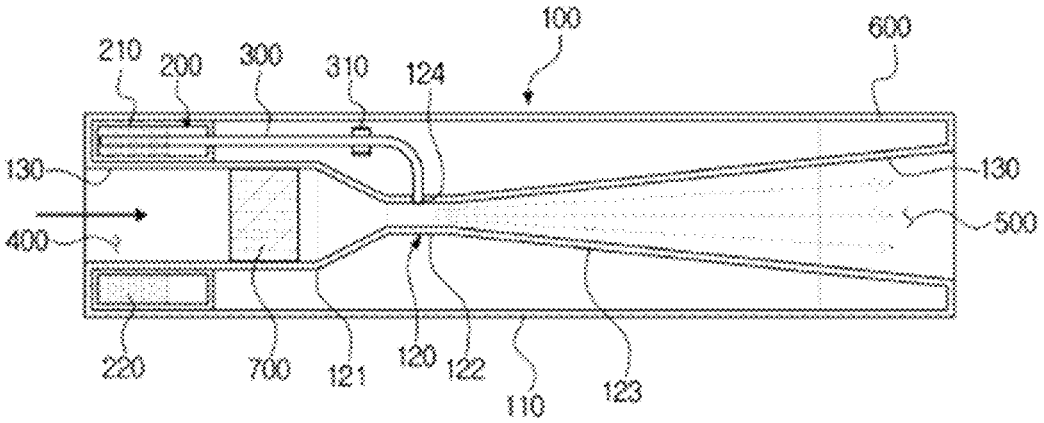

【Figure 5】
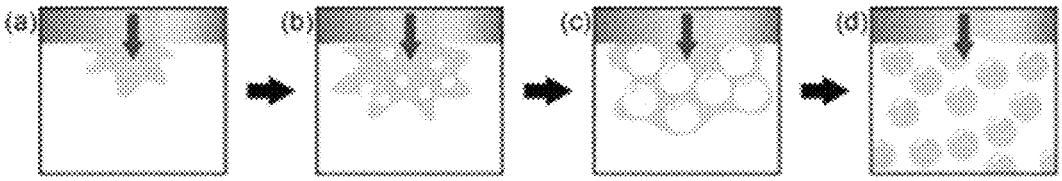
【Figure 6】
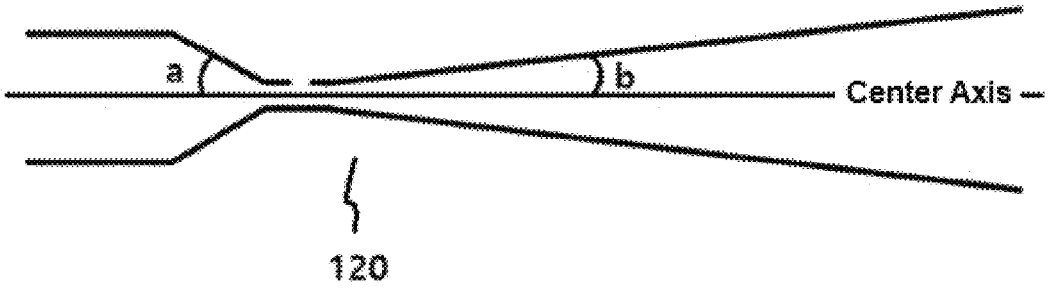

【Figure 7】
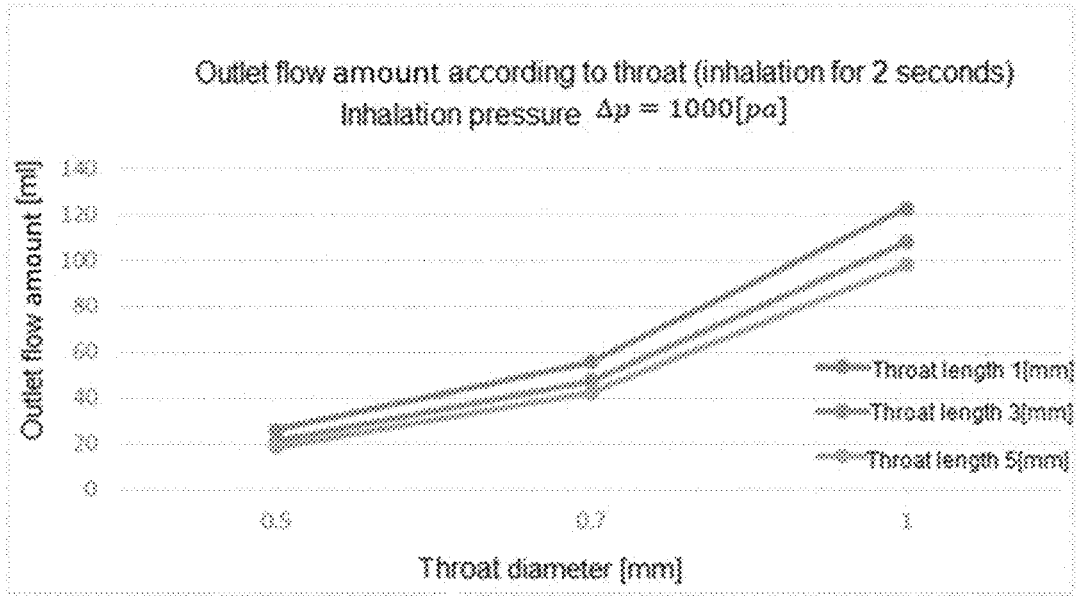
【Figure 8】
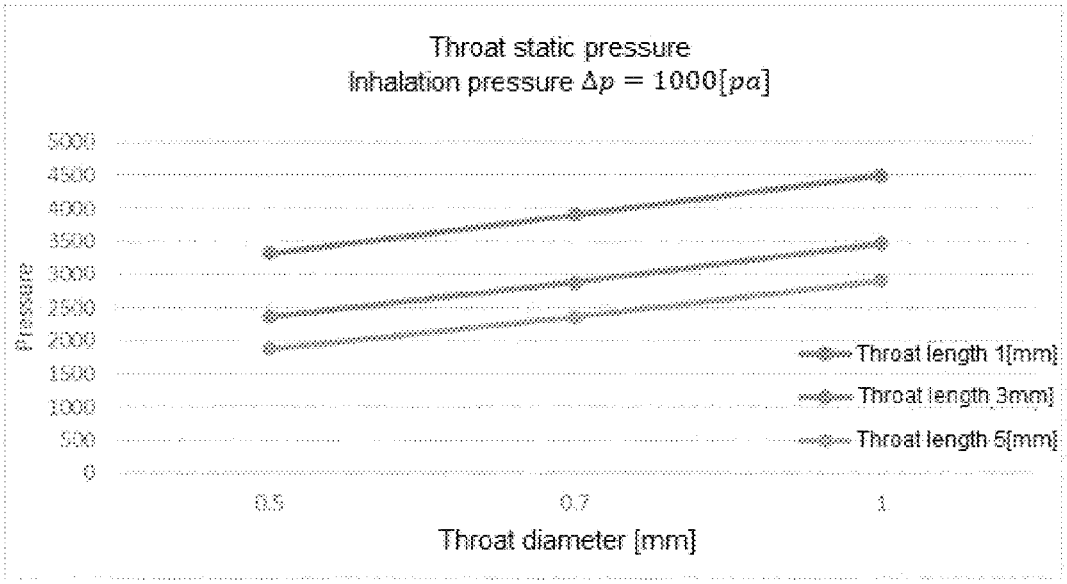

【Figure 9】
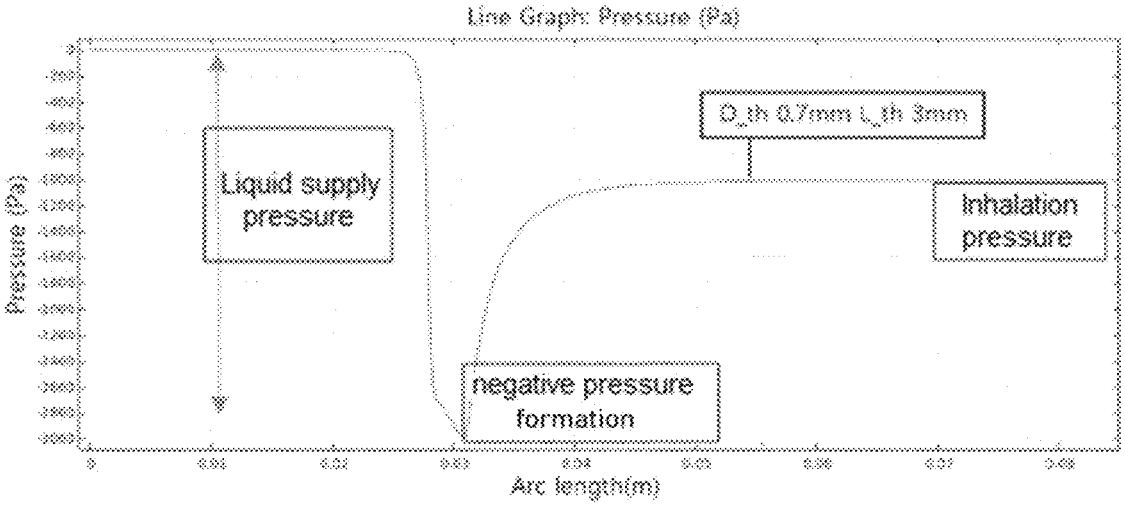
【Figure 10】
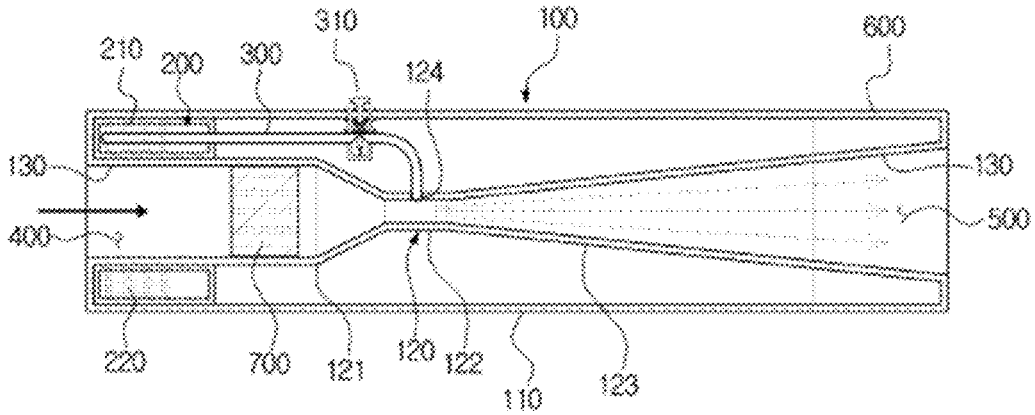

【Figure 11】
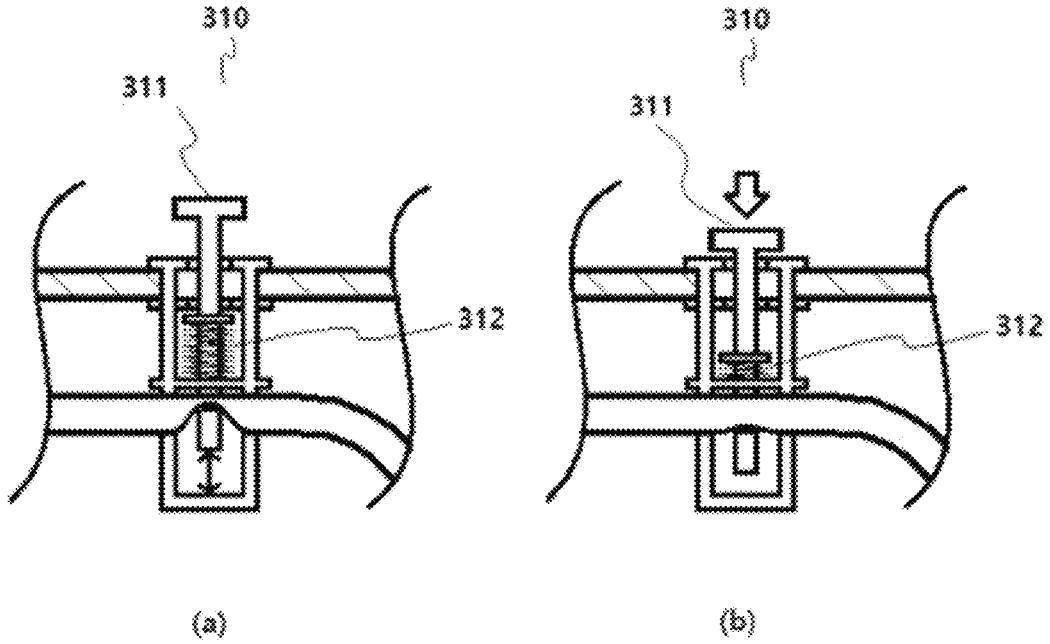

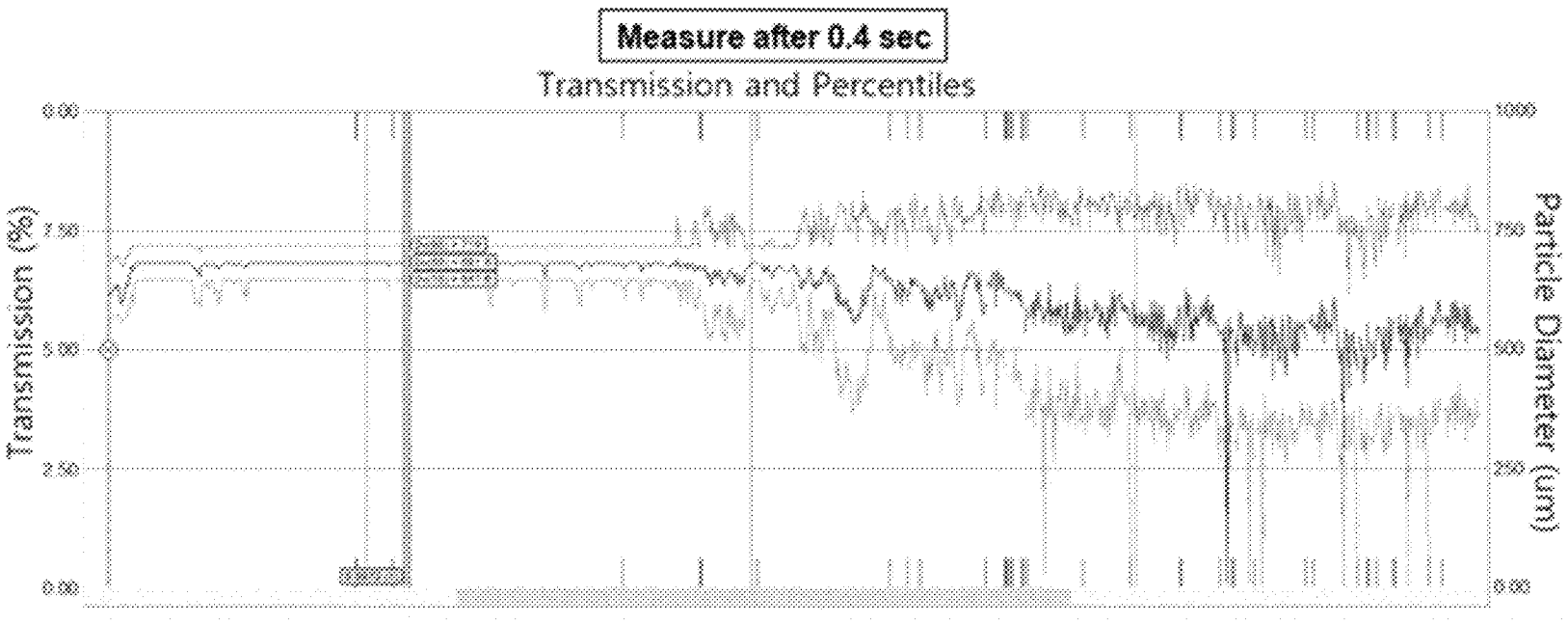
[Figure 12]

【Figure 13】
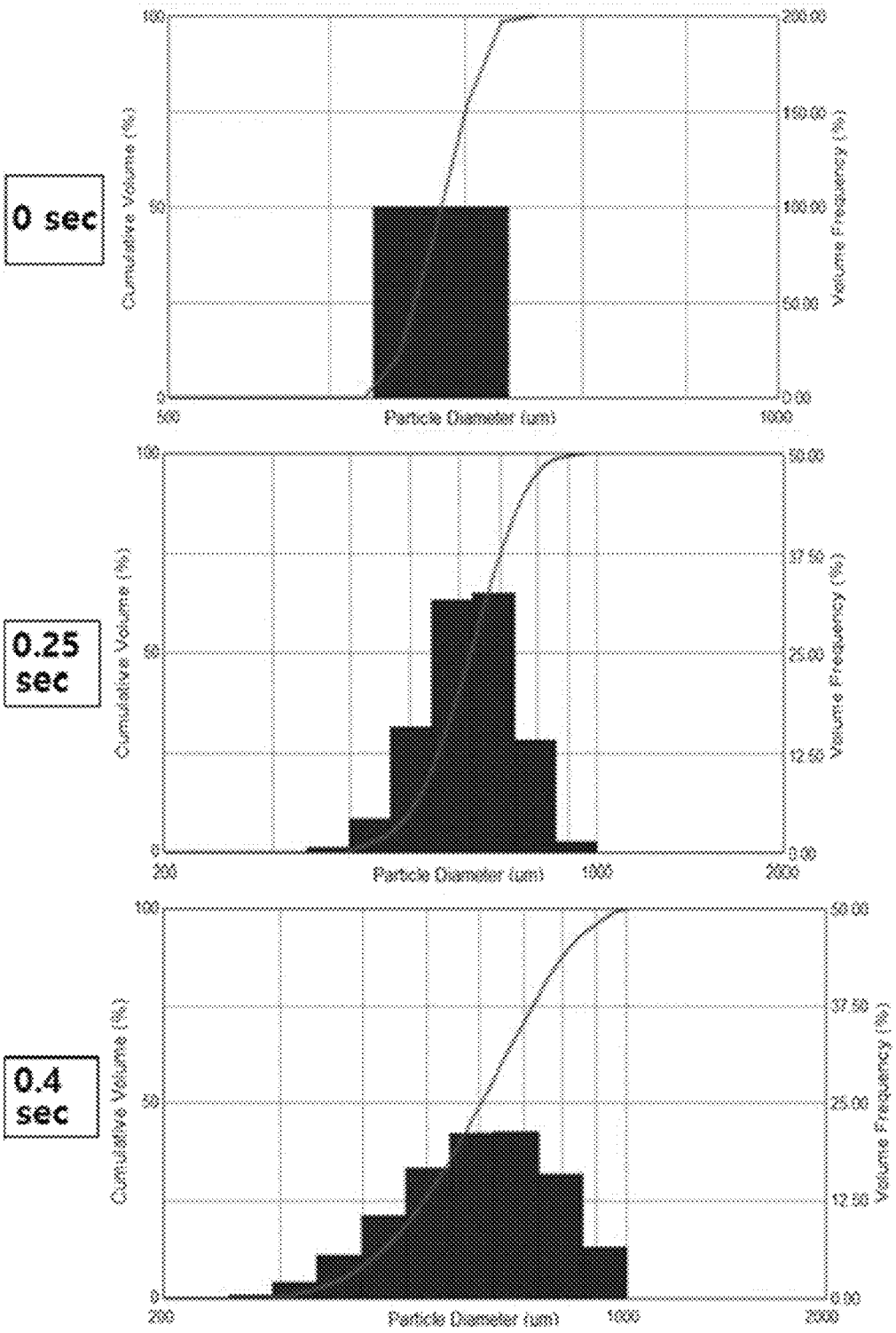

NICOTINE INHALER

CROSS REFERENCE TO RELATED APPLICATIONS

This Application is a National Stage of International Application No. PCT/KR2022/008952 filed Jun. 23, 2022, claiming priority to Korean Patent Application No. 10-2021-0108543 filed on Aug. 18, 2021.

TECHNICAL FIELD

The present invention relates to a nicotine inhaler, and more particularly, to an inhaler capable of aerosolizing and inhaling liquid nicotine.

BACKGROUND ART

A method of delivering nicotine in the form of aerosol to the lungs through an inhaler is an attractive means for delivering nicotine. In this case, the size of aerosol is a very important parameter for satisfaction in smoking. That is because, when aerosol having large particle is inhaled, large drop hits the larynx or airway and thus transmits a negative feeling. That is, the smaller the particle size of nicotine aerosol, the more the nicotine is smoothly inhaled and the deeper the nicotine permeates into the lungs, thereby improving the smoker's satisfaction.

D50 (mass median diameter or average grain size of mass) of cigarette smoke is 0.3, to 0.6 mm. However, the particle size of nicotine aerosol generated by a portable inhaler is significantly different from the particle size of cigarette smoke due to the limitations of the device. Therefore, in order for the method of delivering nicotine aerosol through an inhaler to be loved by smokers, advances in technology to produce fine aerosol particles should be accompanied.

As a conventional aerosol generator, a method of generating aerosol by heating an aerosol forming substrate is well known. However, this device has a defect that a complicated configuration including a heater is required.

Therefore, methods of generating nicotine aerosol using a pressure difference or the like, without employing a method of heating at a high temperature as described above, are being studied. However, these methods have a practical limitation in that it is not easy to generate a pressure difference because the inhaler is used in the atmosphere.

PRIOR ART DOCUMENT

Korean Patent No. 10-1734932

DISCLOSURE

Technical Problem

The present invention has been devised to solve the above problems of the prior art, and aims to provide a nicotine inhaler capable of forming a pressure difference significantly by the user's inhalation and efficiently forming a fine-sized nicotine aerosol using this pressure difference.

Technical Solution

In order to achieve the above objects, the present invention provides a nicotine inhaler including:

a body including a housing and a venturi tube disposed in the housing;

a liquid nicotine storage; and a liquid supplying tube that supplies the liquid nicotine into the venturi tube, wherein the venturi tube includes an inlet pipe section communicating with an air intake port at one end of the housing, a central pipe section having a liquid injection hole on a wall thereof, and an outlet pipe section communicating with an inhalation port at the other end of the housing, and the liquid supplying tube is disposed to communicate with the liquid nicotine storage and the liquid injection hole of the central pipe section.

In an embodiment of the present invention, an end of the outlet pipe section is extended to the inhalation port at the end of the housing to form an inhalation part, and the outlet pipe section may have a form in which a pipe diameter is gradually enlarged from the end of the central pipe section to the inhalation port at the end of the housing.

In an embodiment of the present invention, the end of the inlet pipe section may be extended to the air intake port at the end of the housing to form an air intake section.

In an embodiment of the present invention, the outlet tube section may have a longer length than the inlet tube section.

In an embodiment of the present invention, the inlet pipe section of the venturi tube includes a first tapered portion tapered toward the central pipe section, and the outlet pipe section thereof includes a second tapered portion tapered toward the central pipe section, and an angle formed by the first tapered portion and the center axis of the venturi tube may be larger than an angle formed by the second tapered portion and the center axis of the venturi tube.

In an embodiment of the present invention, the central pipe section may have a diameter of 0.5 mm to 1 mm and a length of 1 mm to 5 mm.

In an embodiment of the present invention, the liquid nicotine storage may be located in a space between the housing and an inner wall of the body including a part or the whole of the venturi tube.

In an embodiment of the present invention, the liquid nicotine storage includes an annular container, and the annular container may be provided in a form surrounding an outer circumferential surface of inner wall of the body.

In an embodiment of the present invention, the liquid supplying tube may have a crimping unit that locks the liquid supplying tube when not inhaling and opens the liquid supplying tube when inhaling.

In an embodiment of the present invention, a diameter of the liquid injection hole may be smaller than a diameter of the liquid supplying tube.

In an embodiment of the present invention, a heating element may be further provided between the air intake port and the venturi tube or in the air intake port side of the venturi tube.

In an embodiment of the present invention, a scent diffusing element may be further provided between the air intake port and the venturi tube or in the air intake port side of the venturi tube.

Advantageous Effects

The nicotine inhaler of the present invention has a venturi tube structure inside the inhaler, and supplies liquid nicotine to a portion forming a negative pressure in the venturi tube, thereby providing an effect of efficiently generating a fine-sized nicotine aerosol.

DESCRIPTION OF DRAWINGS

FIG. 1 is a cutaway perspective view showing an embodiment of a nicotine inhaler of the present invention, FIG. 2 is a cross-sectional view showing an embodiment of the nicotine inhaler of the present invention, FIG. 3 is a cutaway perspective view showing another embodiment of the nicotine inhaler of the present invention, FIG. 4 is a cross-sectional view showing another embodiment of the nicotine inhaler of the present invention, FIG. 5 is a view schematically showing an aerosol generation mechanism by the nicotine inhaler of the present invention, FIG. 6 is a view showing the structure of a venturi tube included in the nicotine inhaler of the present invention, FIG. 7 is a graph showing a flow rate in an inhalation part depending on the diameter and the length of a central pipe section of the venturi tube included in the nicotine inhaler of the present invention, FIG. 8 is a graph showing an inhalation pressure depending on the diameter and the length of the central pipe section of the venturi tube included in the nicotine inhaler of the present invention, FIG. 9 is a graph showing pressure generated by each component when the nicotine inhaler of the present invention is operated, FIG. 10 is a cross-sectional view showing another embodiment of the nicotine inhaler of the present invention, FIG. 11 is an enlarged cross-sectional view of a crimping unit included in the nicotine inhaler of FIG. 10, FIG. 12 is a view showing the result of measuring the aerosol particle size measured after 0.4 seconds when the nicotine inhaler of the present invention is operated, and FIG. 13 is a view showing the result of measuring the distribution of aerosol particle sizes over time during the operation of the nicotine inhaler of the present invention.

BEST MODE

Hereinafter, the present invention will be described in more detail.

The terms and words used in the present specification and claims should not be construed as limited to ordinary or dictionary terms, and should be construed in a sense and concept consistent with the technical idea of the present invention, based on the principle that the inventor can properly define the concept of a term to describe his/her invention in the best way possible.

The terminology used herein is for the purpose of describing particular embodiments only and is not intended to be limiting of the present invention. The singular forms include plural referents unless the context clearly dictates otherwise. It is to be understood that the terms "comprise" or "have" as used in the present specification, are intended to designate the presence of stated features, numbers, steps, operations, components, parts or combinations thereof, but not to preclude the possibility of the presence or addition of one or more other features, numbers, steps, operations, components, parts, or combinations thereof.

The terms "front" and "rear" as used herein are defined based on the flow of aerosol.

Hereinafter, the embodiments of the present invention will be described in detail with reference to the accompanying drawings so that those skilled in the art to which the present invention pertains can easily implement. However, the present invention may be embodied in several different forms, and is not limited to the embodiments described herein.

Hereinafter, the embodiments of the present invention will be described in detail with reference to the drawings.

A nicotine inhaler of the present invention, as shown in FIGS. 1 and 2, includes: a body 100 including a housing 110 and a venturi tube 120 provided inside the housing; a liquid nicotine storage 200; and a liquid supplying tube 300 that supplies the liquid nicotine into the venturi tube 120, wherein the venturi 120 includes an inlet pipe section 121 communicating with an air intake port 400 at one end of the housing, a central pipe section 122 having a liquid injection hole 124 on the tube wall, and an outlet pipe section 123 communicating with an inhalation port 500 at the other end of the housing, and the liquid supplying tube 300 is provided to communicate with the liquid nicotine storage 200 and a liquid injection hole 124 of the central pipe section.

In general, in the nicotine inhaler, it is important to fine-aerosolize the liquid nicotine to facilitate lung inhalation when attempting to inhale a liquid nicotine into the human body. In particular, when a propellant is included in the storage 200 together with the liquid nicotine, since the discharge rate of the liquid nicotine is very fast, a large drop enters the mouth immediately after inhalation and hits the larynx and airways, thereby exhibiting negative sensory characteristics. Accordingly, it is necessary to aerosolize the liquid nicotine more rapidly and finely.

In the nicotine inhaler of the present invention, the liquid nicotine is more finely aerosolized immediately after being discharged by special structures as described above.

A mechanism for aerosolizing the liquid according to the nicotine inhaler of the present invention will be described as follows. When the user inhales air through an inhalation part 600 of the nicotine inhaler shown in FIG. 1, the pressure in the central pipe section 122 of the venturi tube 120 is lowered by Bernoulli's principle. Accordingly, due to the pressure difference, the liquid nicotine 220 accommodated in the liquid nicotine storage 200 is discharged in a liquid state to the liquid injection hole 124 of the central pipe section 122 through the liquid supplying tube 300 (FIG. 5(*a*)), and simultaneously, air bubbles are generated while a propellant is evaporated by the pressure difference (FIG. 5(*b*)). Thereafter, as the air bubbles grow, a liquid film between the air bubbles is broken (FIG. 5(*c*)), and the liquid nicotine is aerosolized (FIG. 5(*d*)). At this time, since the larger the pressure difference, the faster the growth of air bubbles, and also the faster the speed of breaking the liquid film, the aerosol generation efficiency is improved.

In an embodiment of the present invention, as shown in FIG. 1, the end of the outlet pipe section 123 is extended to the inhalation port 500 at an end of the housing 110 to form an inhalation part 600, and the outlet pipe section may have a form in which a pipe diameter is gradually enlarged from the end of the central pipe section 122 to the inhalation port at the end of the housing.

In addition, the end of the inlet pipe section 121 may be extended to the air intake port 400 at an end of the housing 110 to form an air intake section.

In the nicotine inhaler in the form described above, as shown in FIG. 2, it is preferable that the length L2 of the outlet tube section 123 is longer than the length L1 of the inlet tube section 121. This is because it is effective for atomization to form the length of the outlet pipe section 123 to be longer since aerosol is further atomized while flying.

In addition, in the nicotine inhaler in the form described above, the inlet pipe section 121 of the venturi tube 120 includes a first tapered portion tapered toward the central pipe section 122, and the outlet pipe section 123 thereof includes a second tapered portion tapered toward the central pipe section 122. As shown in FIG. 6, it is preferable that the angle (FIG. 6, a) formed by the first tapered portion and the center axis of the venturi tube 120 is larger than the angle (FIG. 6, b) formed by the second tapered portion and the center axis of the venturi. This is because, as described above, since it is advantageous that the length of the outlet pipe section 124 is longer than the length of the inlet pipe section 121 and the size of the air intake port 400 is large, under such conditions, the angle of the first tapered portion cannot but be larger than the angle of the second tapered portion. Further, this is because, to form the pressure of the central pipe section 122 of the venturi tube to be low according to Bernoulli's principle, it is advantageous that the diameter of the inlet pipe section 121 is large.

In an embodiment of the present invention, the central pipe section 122 may be formed with a diameter of 0.5 mm to 1 mm, more preferably 0.6 to 0.8 mm, and a length of 1 mm to 5 mm.

The central pipe section 122 should have a diameter and a length capable of forming an appropriate negative pressure. If the diameter is too narrow and the length is too long, flow rate is rather reduced due to frictional resistance, and the pressure loss occurs, and thus the negative pressure is not sufficiently formed, which is not preferable. Therefore, it is preferable that the diameter and length are formed in the range as described above.

Since an appropriate inhalation flow rate should be secured in the inhalation part, the diameter of the center pipe section 122 should be at least 0.5 mm. This is because, when the diameter is 0.5 mm, it is possible to inhale a mixture of 20 ml of air and liquid nicotine for 2 seconds even with the smallest breathing. In addition, when the diameter exceeds 1 mm, sufficient negative pressure is not formed in the central pipe section, which is disadvantageous for aerosolization.

FIG. 7 shows a flow rate in the inhalation part according to the diameter and the length of the central pipe section 122 described above.

In addition, considering the disposition and size of the liquid injection hole 124, the length of the central pipe section 122 should be longer than 1 mm, and shorter than 5 mm for forming an appropriate negative pressure. FIG. 8 shows an inhalation pressure according to the diameter and the length of the central pipe section 122 described above. FIG. 9 is a graph showing pressure generated by each component when the nicotine inhaler of the present invention is operated.

In an embodiment of the present invention, the liquid nicotine storage 200, as shown in FIG. 1 or 3, may be located in a space between the housing 110 and an inner wall 130 of the body including a part or the whole of the venturi tube 120.

Specifically, the liquid nicotine storage 200 includes an annular container 210, and the annular container may be provided in a form of surrounding the outer circumferential surface of the inner wall 130 of the body.

Such disposition of the liquid nicotine storage 200 makes it possible to manufacture the nicotine inhaler in a compact structure.

In an embodiment of the present invention, the liquid supplying tube 300 may have a crimping unit 310 that locks the liquid supplying tube when not inhaling and opens the liquid supplying tube when inhaling. Since the pressure in the central pipe section of the venturi tube is lowered when the user inhales the inhaler, the crimping unit may be opened by this pressure difference.

For example, when inhaling the inhaler, a sensor for sensing an inhalation pressure and when the sensor senses the inhalation state, the crimping unit may include a solenoid valve that opens the liquid supplying tube according to the sensing result. In this case, the solenoid valve maintains a state in which the liquid supplying tube is closed when not inhaling.

In addition, the crimping unit, as shown in FIGS. 10 and 11, may be a form that is manually operated. That is, the crimping unit may be a form in which, before inhaling the inhaler, the user opens the liquid supplying tube by pressing a crimping rod (FIG. 11, 311), which is supported by a spring 312 and crimps the liquid supplying tube (FIG. 11(*b*)), and after finishing the inhalation, the user returns the liquid supplying tube to the closed state again by releasing the pressure applied to the crimping rod (FIG. 11(*a*)).

Meanwhile, the crimping unit may be formed as a publicly known form. For example, a crimping member described in Korean Patent No. 10-1734932 also may be applied. In this case, in order to apply the crimping member, the structure according to the nicotine inhaler of the present invention may include additional components. For example, the inhalation part 600 may have one more inhalation port communicating with a space between the housing 110 and the inner wall 130 of the body, and the crimping unit 310 may be further provided with a means, which may be operated through the inhalation port when inhaling to release the pressure applied to the liquid supplying tube by the crimping unit.

As a specific example, when applying a crimping member 21 of Korean Patent No. 10-1734932 as described above, a vane having a structure identical or similar to a vane 15 in the form described in Korean Patent No. 10-1734932 may be provided in a space between the housing 110 and the inner wall 130 of the body described in the present invention. If the pressure in the space between the housing 110 and the inner wall 130 of the body is lowered by inhalation of the inhalation part 600 of the inhaler, the vane may include a membrane having a size that can move toward the inner wall of the housing 110 according to the pressure and a pivot provided at the air injection port 400 side one end in the membrane. Accordingly, when inhaling of the inhaler, if the pressure between the membrane and the inner wall of the housing is lowered, the membrane moves toward the inner wall of the housing while rotating around the pivot. The membrane may be provided with a jaw capable of pressing the liquid supplying tube 300 at the lower end. When not inhaling the inhaler, the membrane may be formed in a structure that receives a force downward by an elastic member such as a spring, and by this force, the jaw may press the liquid supplying tube to block the flow of the liquid nicotine. On the other hand, when inhaling the inhaler, as the membrane is raised by the lowered pressure between the membrane and the inner wall of the housing, the jaw is lifted, and thus the pressure on the liquid supplying tube is released, thereby supplying the nicotine liquid. The liquid supplying tube may be manufactured of a flexible material to enable the operation of the crimping means.

In an embodiment of the present invention, to open the crimping element by the negative pressure, it is preferable to form the diameter of the liquid injection hole to be smaller than the diameter of the liquid supplying tube. The diameter of the liquid injection hole may be in the range of 0.1 mm to 0.5 mm. The number of the liquid injection hole 124 may be one or two or more.

In an embodiment of the present invention, the nicotine inhaler may further include a heating element 700 between the air intake port 400 and the venturi tube 120 or in the air intake port side of the venturi tube 120 as shown in FIGS. 3 and 4. The heating element may be, but is not limited to, a heat source by a chemical reaction, a thermoelectric element, a coil heater, a ceramic heater, and the like.

When the liquid nicotine containing a propellant is aerosolized, it is very cold in nature because the temperature temporarily drops rapidly due to sudden expansion. As the heating element is for supplementing it, which is for inhaling inflow air heated by applying the heating element. The heating element is preferably installed in a form that does not significantly impede the flow of air, and may be formed of a porous material.

In an embodiment of the present invention, the nicotine inhaler may further include a scent diffusing element 700 between the air intake port 400 and the venturi tube 120 or in the air intake port side of the venturi tube 120, as shown in FIGS. 3 and 4. The scent diffusing element may help inhalation by adding scent through the inflow air. The scent diffusing element may be a solid scent, a scent included in a porous material, a scented sheet, a scented capsule, etc.

In an embodiment of the present invention, the liquid nicotine may further include a propellant together with a nicotine solution, and those publicly known in the art may be used as the propellant, and for example, HFA-134a, CFC, etc. may be used. The propellant serves to form a pressure inside the liquid nicotine storage container so that the liquid nicotine is easily supplied, and serves to generate air bubbles when the liquid nicotine is discharged into the venturi tube.

Hereinafter, the operation of the nicotine inhaler of the present invention will be described with reference to FIG. 1.

When inhalation occurs in the inhalation part 600 of the nicotine inhaler of the present invention, air is first introduced without pressure loss at the air intake port 400. While the introduced air passes through the central pipe section 122 with a narrow diameter through the inlet pipe section 121 of the venturi tube 120, the speed increases according to Bernoulli's principle, and accordingly while the internal pressure of the central pipe section 122 is lowered, negative pressure is formed. By the negative pressure formed at this time, the crimping unit 310 is opened, and the liquid nicotine stored in the liquid nicotine storage 200 by this pressure difference and the pressure of the propellant itself is supplied passing through the liquid supplying tube 300 into the central pipe section 122 though the liquid injection hole 124. The liquid supplied in this way is loaded into the rapid air flow and moves passing through the outlet pipe section 123 to the inhalation port 500. At this time, air bubbles are quickly and rapidly formed due to the negative pressure, liquid film becomes gradually thinner, and the liquid film is rapidly broken to form an aerosol. The nicotine aerosol is atomized by the friction between the air and the liquid and the surface tension characteristics of the liquid due to the high velocity difference between the air and the liquid while flying in the direction of the inhalation port500 to form a finer aerosol of several μm.

The nicotine inhaler of the present invention is opened at a lower negative pressure than a conventional nicotine inhaler that is opened at atmospheric pressure, thereby forming more air bubbles in the liquid and growing faster, and thus breaking the liquid film faster. Accordingly, the liquid nicotine is more finely atomized by this mechanism.

When operating the nicotine inhaler of the present invention, the particle size and the particle size distribution of the aerosol inhaled into the mouth are measured with a particle size measuring device (product name: Spraytech, manufacturer name: Malvern), and the results are shown in FIGS. 12 and 13. As confirmed in the above drawings, the nicotine inhaler of the present invention shows excellent aerosolization characteristics.

Although the present invention has been described with reference to preferred embodiments described above, various modifications and changes can be made without deviating from the gist and scope of the invention. Accordingly, the appended claims will include such modifications and changes within the gist of the present invention.

[Description of Reference Numerals]

| | |
|---|---|
| 100: body | 110: housing |
| 120: venturi tube | 121: inlet pipe section |
| 122: central pipe section | 123: outlet pipe section |
| 124: liquid injection hole | 130: inner wall |
| 200: liquid nicotine storage | 210: liquid storage container |
| 220: liquid nicotine | 300: liquid supplying tube |
| 310: crimping unit | 311: crimping rod |
| 312: spring | 400: air intake port |
| 500: inhalation port | 600: inhalation part |
| 700: heating element or scent diffusing element | |

The invention claimed is:

1. A nicotine inhaler comprising:

a body including a housing and a venturi tube disposed in the housing;

a liquid nicotine storage;

a liquid supplying tube configured to supply liquid nicotine from the liquid nicotine storage into the venturi tube, wherein the venturi tube includes an inlet pipe section communicating with an air intake port at one end of the housing, a central pipe section having a liquid injection hole on a wall thereof, and an outlet pipe section communicating with an inhalation port at the other end of the housing; and a heating element disposed between the air intake port and the inlet pipe section of the venturi tube, wherein the liquid supplying tube is disposed to communicate with the liquid nicotine storage and the liquid injection hole of the central pipe section, the liquid supplying tube comprises a crimping unit configured to lock the liquid supplying tube when the nicotine inhaler is not being inhaled and open the liquid supplying tube when the inhaler is being inhaled, and a diameter of the liquid injection hole is smaller than a diameter of the liquid supplying tube.

2. The nicotine inhaler of claim 1, wherein an end of the outlet pipe section is extended to the inhalation port at the other end of the housing to form an inhalation part, and the outlet pipe section has a form in which a pipe diameter is gradually enlarged from an end of the central pipe section to the inhalation port at the other end of the housing.

3. The nicotine inhaler of claim 2, wherein the end of an inlet pipe section is extended to the air intake port at the one end of the housing to form an air intake section.

4. The nicotine inhaler of claim 3, wherein the outlet pipe section has a longer length than the inlet pipe section.

5. The nicotine inhaler of claim 4, wherein the inlet pipe section of the venturi tube includes a first tapered portion tapered toward the central pipe section, and the outlet pipe section thereof includes a second tapered portion tapered toward the central pipe section, and an angle formed by the first tapered portion and a center axis of the venturi tube is larger than an angle formed by the second tapered portion and the center axis of the venturi tube.

6. The nicotine inhaler of claim 1, wherein the central pipe section has a diameter of 0.5 mm to 1 mm and a length of 1 mm to 5 mm.

7. The nicotine inhaler of claim 1, wherein the liquid nicotine storage is located in a space between the housing and an inner wall of the body including a part or the whole of the venturi tube.

8. The nicotine inhaler of claim 7, wherein the liquid nicotine storage includes an annular container, and the annular container is provided in a form surrounding an outer circumferential surface of the inner wall of the body.

9. The nicotine inhaler of claim 1, wherein the diameter of the liquid injection hole is 0.1 mm to 0.5 mm.

* * * * *